United States Patent [19]

Momoki

[11] Patent Number: 4,914,010

[45] Date of Patent: Apr. 3, 1990

[54] SILVER HALIDE COLOR PHOTOGRAPHIC MATERIAL

[75] Inventor: Yasuhito Momoki, Ashigara, Japan

[73] Assignee: Fuji Photo Film Co., Ltd., Kanagawa, Japan

[21] Appl. No.: 396,775

[22] Filed: Jul. 31, 1989

Related U.S. Application Data

[63] Continuation of Ser. No. 279,224, Nov. 28, 1988, abandoned, which is a continuation of Ser. No. 892,964, Aug. 4, 1986, abandoned.

[30] Foreign Application Priority Data

Aug. 5, 1985 [JP] Japan ..... 60-172018

[51] Int. Cl.[4] ..... G03C 5/30; G03C 1/02

[52] U.S. Cl. ..... 430/399; 430/567; 430/569

[58] Field of Search ..... 430/567, 569, 399

[56] References Cited

U.S. PATENT DOCUMENTS 4,414,306 11/1983 Wey et al. ..... 430/569
4,433,048 2/1984 Solberg et al. ..... 430/569
4,434,226 2/1984 Wilgus et al. ..... 430/569
4,507,386 3/1985 Matsuzaka et al. ..... 430/569
4,564,591 1/1986 Tanaka et al. ..... 430/567
4,585,729 4/1986 Sugimoto et al. ..... 430/567

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A color photographic material in which at least one chemically sensitized silver halide photographic emulsion is coated on a support, with the silver halide photographic emulsion comprising silver halide grains in which tabular grains having an aspect ratio of not less than 5 comprise at least 50% on the total projected area of all grains and the halide composition of the silver halide is at least 95 mole % bromide, substantially no iodide and the remainder chloride. High photographic speed, low fog, high developability and excellent processing stability in rapid processing at high temperature using reduced amounts of replenishers are achieved.

8 Claims, No Drawings

SILVER HALIDE COLOR PHOTOGRAPHIC MATERIAL

This is a continuation of application Ser. No. 279,224, filed Nov. 28, 1988, which is a continuation of Ser. No. 892,964, filed Aug. 4, 1986, both abandoned.

FIELD OF THE INVENTION

The present invention relates to a silver halide color photographic material, and, in more detail, to a silver halide color photographic material which is excellent in developability and processing stability and has high photographic speed and low fog density. Particularly, the invention is well suited for color photographic paper.

BACKGROUND OF THE INVENTION

The demand for rapid processing has grown with the recent increases in the quantity of color photographic materials to be processed, and development processing has tended in the direction of higher development temperatures and reducing the number of processing baths.

It is known that sensitive materials where a rapid development step as described above is required acquire more excellent developability the higher the silver chloride content is in a silver chlorobromide emulsion employed. However, silver chlorobromide emulsions having a high chloride content are known to have a tendency to fog and to be inferior in storage stability.

In the case of using emulsions as described above, it is therefore difficult to produce stable color photographic materials which can be subjected to high temperature rapid processing and which generate reduced fog. In particular, the recent introduction of smallscale laboratories (mini-labos) and, jointly therewith, the trend in the development industry of keeping down the administrative cost of laboratories has led to rapid progress in development processing using lowered amounts of replenishers (LR processing). However, in the case where silver chlorobromide emulsions having a high silver chloride content receive such rapid and. LR processing, they practically suffer from the serious problem that rapid and LR processing causes undesirable changes therein, mainly the generation of fog.

For the purpose of producing a light-sensitive material which can be rapid processed and has improved photographic speed, Japanese Patent Application (OPI) No. 108533/83 (the term "OPI" as used herein means an "unexamined published application") proposed the use of a silver halide emulsion comprising silver halide grains in which the halide composition of the silver halide as a whole was mainly silver chloride, more specifically 90 to 99.5 mole % chloride, remainder bromide, and a layer made up mainly of silver bromide was located at the individual surfaces of the grains.

However, such emulsions having a high silver chloride content, though they have improved developability, cannot ensure lower fog density in high temperature LR processing. Therefore, they have proven to be insufficient as a light-sensitive material for high temperature, rapid and LR processing which has both high photographic speed and show low fog density.

Further, Japanese Patent Application (OPI) No. 48755/84 proposed a specific silver halide emulsion for the purpose of obtaining a color photographic material which had both aptitude for rapid processing and reduced fog. This silver halide emulsion comprised core/- shell type silver halide grains in which the halide composition of the silver halide was 50 to 97 mole % bromide, not more than 2 mole % iodide, remainder chloride, and the bromide content in the shell was higher than that in the core.

However, the above described core/shell type silver halide emulsion having the specified halide composition proved to be insufficient to provide a light-sensitive material capable of being subjected to high temperature, rapid and LR processing, particularly from the viewpoint of processing rapidity.

On the other hand, apart from increasing the silver chloride content, it has been known that developability can be improved by using tabular-shaped silver halide grains.

For instance, a tabular silver chlorobromide emulsion in which the tabular grains have parallel [111] planes facing one another as the major plane, a thickness of less than 0.3 μm, a diameter of 0.6 μm or more, a mean aspect ratio of 7 or more, and a silver chloride content of 40 mole % or less was proposed in Japanese Patent Application (OPI) No. 111936/83, which showed such an emulsion to have high developing speed and a high efficiency in spectral sensitization. However, there was no disclosure of a way to cope with the high temperature, rapid and LR processing in that patent specification. In practice, it has been found out that the tabular silver chlorobromide grains specified by the foregoing physical properties alone are insufficient to provide a light-sensitive material suited to rapid and LR processing which is essentially free from fog.

SUMMARY OF THE INVENTION

As a results of extensive investigation, it has now been found that emulsions which ensure high photographic speed and reduced fog and which are excellently suited for high temperature, rapid and LR processing can be obtained only by using tabular silver halide grains having an aspect ratio of 5 or more whereby they exhibit excellent developability, which tabular grains have a specified halide composition which is at least 95 mole % bromide, substantially no iodide and the remainder chloride.

Therefore, an object of the present invention is to provide a light-sensitive silver halide photographic emulsion excellent in developability and processing stability and with high photographic speed and low fog density.

Another object of the present invention is to provide a silver halide color photographic material in which the above-described silver halide emulsion is employed, whereby the photographic material has high photographic speed, the ability to prevent the generation of fog, excellent developability and high processing stability, that is, which is excellently suited high temperature, rapid and LR processing.

The above-described objects are attained with a color photographic light-sensitive material where at least one silver halide photographic emulsion is coated on a support, the photographic emulsion comprising silver halide grains in which tabular grains having an aspect ratio of not less than 5 are present so as to amount to at least 50% of the total projected area of all silver halide grains present and the halide composition of the silver halide is at least 95 mole % bromide, substantially no iodide and the remainder chloride.

DETAILED DESCRIPTION OF THE INVENTION

In the silver halide emulsion employed in the present invention, tabular silver halide grains having an aspect ratio of not less than 5 are present in an amount of 50% or more, based on the total projected area of all grains present in the emulsion. The term "aspect ratio" used in this specification refers to the ratio of the diameter of the grain to the thickness thereof. The term "diameter" of the grain signifies the diameter of a circle having the same area as the projected area of the grain which is determined by observation under a microscope or an electron microscope.

More specifically, the thickness and the diameter of individual grains can be measured by shadow electron micrography and the aspect ratios of the tabular grains present can be determined. The mean aspect ratio can be obtained by averaging the aspect ratios of all the tabular grains present in the sample.

Further, the projected areas of the tabular grains which have an aspect ratio of 5 or more can be integrated, and those of the remaining silver halide grains in the electron microphotograph can be integrated separately. From these two integrated values, the fraction of the tabular grains having an aspect ratio of 5 or more in the total projected area of all the silver halide grains can be calculated.

The diameter of the tabular silver halide grains generally ranges from 0.1 to 10 μm, preferably from 0.2 to 5.0 μm, and particularly preferably from 0.3 to 2.0 μm.

The thickness of the tabular silver halide grains is represented by the distance between the two major parallel faces which form the grain.

More desirable tabular silver halide grains for use in the present invention are those having a diameter ranging from 0.2 to 5.0 μm, a thickness of 0.3 μm or less and a mean aspect ratio of from 5 to 8. Most advantageous tabular silver halide photographic emulsions used in the present invention are emulsions in which grains having a grain diameter ranging from 0.3 to 2.0 μm and an average diameter/average thickness ratio of 5 or more comprise 85% or more of the silver halide grains present based on the total projection area of all the silver halide grains present.

The size distribution of the tabular silver halide grains employed in the present invention may be either narrow or broad.

Also, two or more kinds of tabular grains differing in size may be used in blended form, depending on the photographic gradation desired.

The halide composition of the silver halide grains according to the present invention is at least 95 mole % bromide, substantially no iodide and the remainder chloride. The expression "substantially no iodide" used above means that the content of silver iodide in the grain is not more than 2 mole %, preferably not more than 0.5 mole %, and more preferably 0%.

Tabular silver halide emulsions which can be employed in the present invention are described in the reports of Cugnac and Chateau; Duffin, *Photographic Emulsion Chemistry*, pages 66 to 72, The Focal Press, New York (1966); and *Photo. Journal*, edited by A. P. H. Trivelli and W. F. Smith, vol. 80, page 285 (1940), and they can be easily made by reference to the methods described in Japanese Patent Application (OPI) Nos. 113927/83, 113928/83 and 127921/83, and so on.

For instance, a tabular silver halide emulsion can be obtained in the following manner. Firstly, seed crystals in which tabular grains are present in a proportion of 40% or more by weight are prepared under condition such that the pBr is kept at 1.3 or less, that is, under a relatively high pAg condition, and then the seed crystals are grown by the simultaneous addition of silver and halide solutions under the condition such that the pBr is maintained to a similar extent as described above. In the grain growth process, it is desirable to add the silver solution and the halide solution under conditions, such as to not cause further nucleation.

The size of the tabular silver halide grains can be adjusted within a desired range by controlling reaction temperature, selecting the kind and the quality of solvent used, controlling the addition rates of the silver salt and halide used at the time of grain growth, etc.

In producing the tabular silver halide grains of the present invention, a silver halide solvent can optionally be used, whereby grain size, grain shape (e.g., the diameter/thickness ratio, etc.), grain size distribution, and the rate of grain growth can be controlled. It is preferable to use the solvent in a concentration ranging from $10^{-4}$ to 1.0 wt %, particularly from $10^{-3}$ to $10^{-1}$ wt %, of the reaction solution. As the addition amount of a silver halide solvent is increased, the grain size distribution of the tabular grains of the present invention becomes nearer to a monodispersed system and the grain growth rate can be increased, but unfortunately the thickness of the tabular grains tends to be increased.

Silver halide solvents which can be employed in the present invention include these conventionally used. Frequently used silver halide solvents are ammonia, thioethers, thioureas, thiocyanates, thiazolinethiones and the like. For details of thioethers, U.S. Pat. Nos. 3,271,157, 3,574,628 and 3,790,387, and so on can be referred to. For details of thioureas, Japanese Patent Application (OPI) Nos. 82408/78 and 77737/80, for details of thiocyanates, U.S. Pat. Nos. 2,222,264, 2,448,534 and 3,320,069, and for details of thiazolinethiones, Japanese Patent Application (OPI) No. 144319/78 can be referred to, respectively.

In the process for producing the tabular silver halide grains or allowing the produced grains to physically ripen, cadmium salts, zinc salts, lead salts, thallium salts, iridium salts or complexes, rhodium salts or complexes, iron salts or complexes, and/or the like may be present in order to prevent the occurrence of reciprocity law failure.

In producing the tabular silver halide grains employed in the present invention, it is desirable, for the purpose of speeding up grain growth, to employ the methods of increasing addition rates, addition amounts and addition concentrations of a silver salt solution (e.g., an aqueous solution of $AgNO_3$) and a halide solution (e.g., an aqueous solution of KBr). For details of these methods the descriptions given e.g., in British Pat. No. 1,335,925, U.S. Pat. Nos. 3,650,757, 3,672,900 and 4,242,445, and Japanese Patent Application (OPI) Nos. 142329/80 and 158124/80 can be referred to.

The tabular silver halide grains of the present invention are chemically sensitized, if desired.

For chemical sensitization, sulfur sensitization using active gelatin or compounds containing sulfur capable of reacting with silver ion (e.g., thiosulfates, thioureas, mercapto compounds, rhodanines, etc.), reduction sensitization using reducing materials (e.g., stannous salts, amines, hydrazine derivatives, formamidinesulfinic acid, silane compounds, etc.), and noble metal sensitization using noble metal compounds (e.g., gold complex salts, and complex salts of metals belonging to Group VIII of the periodical table such as Pt, Ir, Pd, etc.) can be employed individually or as a combination thereof.

As for specific examples of these sensitization processes, sulfur sensitizations are described, e.g., in U.S. Pat. Nos. 1,574,944, 2,278,947, 2,410,689, 2,728,668 and 3,656,955, and so on, reduction sensitizations are described, e.g., in U.S. Pat. Nos. 2,419,974, 2,983,609 and 4,054,458, and so on, and noble metal sensitizations are described, e.g., in U.S. Pat. Nos. 2,399,083 and 2,448,060, British Pat. No. 618,061, and so on.

In particular, it is advantageous, from the viewpoint of saving silver, to subject the tabular grains of the present invention to gold sensitization or sulfur sensitization, or a combination of these sensitizations.

The tabular silver halide grains of the present invention can be spectrally sensitized with methine dyes or other dyes, if desired.

Various kinds of color couplers can also be used in the present invention. Useful color couplers are cyan, magenta and yellow color-forming couplers. Typical examples of these couplers include naphthol or phenol compounds, pyrazolone or pyrazoloazole compounds, and open-chain or heterocyclic ketomethylene compounds. Specific examples of these cyan, magenta and yellow couplers which can be used in the present invention are described in the patents cited in *Research Disclosure,* No. 17643, Section VII-D (Dec. 1978) and ibid., No. 18717 (Nov. 1979). Standard amounts of color couplers used are within the range of 0.001 to 1 mole per mole of light-sensitive silver halide. Preferably, yellow couplers are used in an amount of from 0.01 to 0.5 mole, magenta couplers in an amount of from 0.003 to 0.3 mole, and cyan couplers in an amount of from 0.002 to 0.3 mole, per mole of light-sensitive silver halide.

The present invention can also be applied to a multilayer multicolor photographic material having at least two layers of different color sensitivities on a support. A multilayer color photographic material has, in general, at least one red-sensitive emulsion layer, at least one green-sensitive emulsion layer and at least one blue-sensitive emulsion layer on a support. The order of these layers can be varied as desired. Each of the above described emulsion layers may have two or more constituent layers differing in sensitivity, and a light-insensitive layer may be arranged between any two constituent layers having the same color sensitivity.

In addition t the above described silver halide emulsion layers, it is often desired to provide auxiliary layers, such as a protective layer, an interlayer, a filter layer, an antihalation layer, a backing layer and so on in the light-sensitive material according to the present invention.

In the photographic light-sensitive material of the present invention, photographic emulsion layers and other layers are coated on a conventionally used flexible support, such as a plastic film, paper, cloth or the like, or a rigid support such as glass, ceramics, metals or so on. Of these supports, baryta paper or a paper support laminated with polyethylene films in which a white pigment (e.g., titanium oxide) is dispersed are more preferred as a support per the present invention.

The present invention can be applied to various kinds of color photographic materials. Representative color photographic materials to which the present invention can be applied are color negative films for amateur use or motion picture use, color reversal films for slide use or television use, color paper, color positive films, and color reversal paper. Among these materials, color paper is preferred over others. The present invention can also be applied to a black-and-white photographic material which utilizes the process of mixing three color couplers, as described in *Research Disclosure,* No. 17123 (July 1978).

The term "high temperature" in the high temperature rapid processing to be employed in the present invention is intended to include development temperatures of 30° C. or higher, and the expression "LR processing" means, for example, that the content of KBr in the initial developing solution is adjusted to 1.0 g/l or more, and the amount of a replenisher added to the developing solution is reduced to 50 to 60 vol % of the replenishing amount in standard processing.

A color developing solution to be used for development processing of the photographic material of the present invention is an aqueous alkaline solution preferably containing an aromatic primary amine type color developing agent as a main component. Preferred developing agents of such a type are p-phenylenediamine compounds. Representative of such compounds ar 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochloride or p-toluenesulfonates of the above-cited anilines.

The color developing solution generally can contain pH buffering agents such as carbonates, borates or phosphates of alkali metals, and development inhibitors or antifoggants such as bromides, iodides, benzimidazoles, benzothiazoles or mercapto compounds. Further, preservatives such as hydroxylamines or sulfites, organic solvents such as triethanolamine or diethylene glycol, development accelerators such as benzyl alcohol, polyethylene glycol, quaternary ammonium salts or amines, dye-forming couplers, competing couplers, nucleating agents such as sodium borohydride, auxiliary developers such as 1-phenyl-3-pyrazolidones, viscosity-imparting agents, various kinds of chelating agents represented by aminopolycarboxylic acids, aminopolyphosphonic acids, alkylphosphonic acids, phosphonocarboxylic acids and the like, antioxidants as described in West German Patent Application (OLS) No. 2,622,950, and so on may be added to the color developing solution, if desired.

After exposure and subsequent color development, the photographic material of the present invention is subjected to bleach processing and fix processing (which may be carried out in either a monobath (blix) or separate baths).

Suitable examples of bleaching agents which can be used include complex salts of organic acids and Fe(III) or Co(III). Specific examples of organic acids usable for producing such complex salts include ethylenediaminetetraacetic acid, diethylenetriaminepentaacetic acid, nitrilotriacetic acid, 1,3-di-amino-2-propanol tetraacetic acid and other aminopolycarboxylic acids, citric acid, tartaric acid and malic acid. Of these complex salts, ethylenediaminetetraacetatoferrate(III) complex salts and ethylenetriaminepentaacetataferrate(III) complex salts are particularly useful in a bleach-fix bath.

To a bleach-fix bath may be added various accelerators in combination. For example, in addition to bromine ions and iodine ions, thiourea compounds as described in U.S. Pat. No. 3,706,561, Japanese Patent Publication Nos. 8506/70 and 26586/74, and Japanese Patent Application (OPI) Nos. 32735/78, 36233/78 and 37016/78; thioether compounds as described in Japanese Patent Application (OPI) Nos. 124424/78, 95631/78, 57831/78, 32736/78, 65732/78 and 52534/79, U.S. Pat. No. 3,893,858, and so on; heterocyclic compounds as described in Japanese Patent Application (OPI) Nos. 59644/74, 140129/75, 28426/78, 141623/78, 104232/78 and 35727/79, and so on; thioether compounds as described in Japanese Patent Application (OPI) Nos. 20832/77, 25064/80 and 26506/80, and so on; tertiary amines as described in Japanese Patent Application (OPI) No. 84440/73; thiocarbamoyls as described in Japanese Patent Application (OPI) No. 42349/74; and so on can be employed alone or as a combination of two or more thereof. Of these substances, bromine ions, iodine ions, thiol compounds and disulfide compounds function effectively as bleach accelerators. These bleach accelerators are especially effective in bleach-fixing color photographic materials for picture taking use.

As examples of usable fixing agents, mention may be made of thiosulfates, thiocyanates, thioether compounds, thioureas, a high amount of iodide, and so on. In general, thiosulfates are used as fixing agent. As preservatives for a bleach-fix bath or a fixing bath, sulfites, bisulfites and the adducts of carbonyl and bisulfites are preferably used.

After bleach-fix processing or fix processing, washing is generally carried out. In the step of washing, the addition of various known compounds may be carried out for the purposes of preventing precipitation and saving washing water. In order to prevent precipitation from occurring, a water softener such as an inorganic phosphoric acid, an aminopolycarboxylic acid, an organic phosphonic acid, or so on; a germicide and a bactericide for inhibiting various bacteria, algae and mold from breaking out; a hardener represented by a magnesium salt or an aluminium salt; a surface active agent for lightening the drying load and preventing drying marks from generating; and so on can be added, if needed. Also, the compounds described in L. E. West, *Photo. Sci. Eng.*, vol. 6, pp. 344–359 (1965) may be added. In particular, the addition of chelating agents and bactericides is effective.

The washing step is, in general, carried out using two or more tanks according to the counter-current washing method for the purpose of saving water. On the other hand, a multistage counter-current stabilization processing as described in Japanese Patent Application (OPI) 8543/82 may be carried out in place of washing. To the stabilizing bath can be added various kinds of compounds in order to stabilize developed images. As typical examples of such additives, mention may be made of various buffering agents for adjusting the pH to a proper value (generally ranging from 3 to 8), such as those obtained by properly combining acids and alkalis selecting from among borates, metaborates, borax, phosphates, carbonates, potassium hydroxide, sodium hydroxide, aqueous ammonia, monocarboxylic acids, dicarboxylic acids, polycarboxylic acids and the like, and formaldehyde. The stabilizing bath may further contain a water softener (e.g., inorganic phosphoric acids, amonopolycarboxylic acids, organic phosphonic acids, aminopolyphosphonic acids, phosphocarboxylic acids, or so on), a germicide (e.g., benzisothiazolinone, isothiazolone, 4-thiazolinebenzimidazole, halogenated phenols, so on), a surface active agent, a brightening agent, a hardener and other various kinds of additives, if desired. Two or more kinds of compounds may be used for the same purpose or different purposes.

In addition, it is desired that various ammonium salts, such as ammonium chloride, ammonium nitrate, ammonium sulfate, ammonium phosphate, ammonium sulfite, ammonium thiosulfate and the like, be added to the stabilizing bath in order to control the pH in the processed film.

A color developing agent may be incorporated into the silver halide color photographic material of the present invention for the purpose of simplifying and quickening the photographic processing. Incorporation of the color developing agent is carried out to advantage by using it in the form of precursor.

Further, various 1-phenyl-3-pyrazolidones may optionally be incorporated in the silver halide color photographic material of the present invention for the purpose of accelerating color development.

The present invention is illustrated in greater detail by reference to the following example. However, the invention is not intended to be construed as being limited to this example. All percents and the like are by weight unless otherwise indicated.

EXAMPLE

NaCl (24.2 g) and 1.1 g of KBr were added to 900 ml of a 3% aqueous solution of gelatin, and dissolved therein. The resulting solution was kept at 60° C. and 22.5 ml of a 17% aqueous solution of $AgNO_3$ (60° C.) and an aqueous solution containing 100 g of KBr and 37 g of NaCl in 1,000 ml of water (60° C.) were added thereto in 5 minutes with vigorous stirring in accordance with the known double jet method. During the addition, the dropping rate of the aqueous alkali halide solution was controlled so as to keep the pAg of the reaction system at its initial value of +60 mV.

To the thus prepared emulsion were subsequently added 566.4 ml of an aqueous $AgNO_3$ solution having the same concentration as described above and 566.4 ml of the aqueous alkali halide solution according to the double jet method. During the addition, the volume of the aqueous $AgNO_3$ solution added (v ml/min) was increased so as to obey the following equation at any point in t minutes after the beginning of the addition:

$$v=4.4+0.138t$$

On the other hand, an addition volume of the aqueous alkali halide solution was altered with the passage of time to retain the initial pAg value in the reaction system.

After soluble salts were removed from the resulting emulsion using a sedimentation process, 56 g of gelatin was further added to the emulsion, whereby redispersion was effected. Further, sodium thiosulfate was added to the redispersed emulsion at 50° C. in an amount of 6 mg per mole of silver halide to result in optimal chemical sensitization.

The thus obtained emulsion was named Emulsion A. In Emulsion A, tabular grains accounted for 80% of the total projected area of all silver halide grains contained therein. The mean thickness of the tabular grains was 0.14 μm, the mean aspect ratio thereof was 7, and the mean grain diameter was 0.70 μm by measurement with a Coulter Counter Model TA-II, made by Coulter Electronics, Inc. The content of AgBr was 85 mol % and the balance AgCl.

Emulsions B to E were prepared in the same manner as Emulsion A except that the amount of NaCl and KBr added to the 3% aqueous solution of gelatin were variously changed so as to control the pAg values to be maintained at levels higher than that used in the preparation of Emulsion A.

Emulsions B to E had the same profile as Emulsion A with respect to the silver halide grains comprised therein except that content of AgBr was 93%, 96%, 98% and 100% actively and the balance AgCl.

Other emulsions for comparison (Emulsions F to I) comprising non-tabular silver chlorobromides differing in halide composition, respectively, were prepared in the following manner.

Five grams (5 g) of NaCl was added to 900 ml of a 3% aqueous gelatin solution and dissolved therein. The resulting solution was kept at 70° C. and thereto, 589 ml of a 17% aqueous $AgNO_3$ solution (60° C.) and 589 ml of a halide solution containing KBr (60° C.) in a concentration of 10% and NaCl in a concentration of 5% were added with vigorous stirring over a period of 60 minutes according to the double jet method. Thereafter, the thus prepared emulsion was subjected to optimal chemical sensitization in the same manner as Emulsion A. This emulsion was named Emulsion F. The silver halide grains in Emulsion F had a non-tabular shape, the mean grain size thereof was 0.70 μm and an AgBr content therein was 85 mol % and the balance AgCl.

Separately, Emulsions G to I were prepared in the same manner as Emulsion F except that the KBr and NaCl concentrations in the halide solution added using the double jet method and preparation temperatures were varied.

The silver halide grains in Emulsions G to I each had a non-tabular form and the mean grain size thereof was 0.70 μm. The content of AgBr was 96 mol % in Emulsion G, 50 mol % in Emulsion H, and 10 mol % in Emulsion I, and the balance AgCl.

On a paper support laminated with polyethylene on both sides there were coated seven constituent layers to prepare a color photographic light-sensitive material. In the polyethylene laminate present on the side where the first layer was provided, titanium dioxide and a trace amount of ultramarine were incorporated in conventional amounts.

The ingredients present in each constituent layer (from the first layer to the seventh layer) are described below.

The number corresponding to each ingredient represents the coverage expressed in gram(s) per square meter ($g/m^2$). So far as the silver halide is concerned, however, its coverage is expressed as silver basis.

| | |
|---|---|
| First Layer (Blue-Sensitive Layer): | |
| Emulsion A | 0.30 |
| Yellow Coupler (*1) | 0.70 |
| Solvent for Yellow Coupler (TNP) | 0.15 |
| Gelatin | 1.20 |
| Second Layer (Interlayer): | |
| Gelatin | 0.90 |
| Di-t-octylhydroquinone | 0.05 |
| Solvent for Ingredients above (DBP) | 0.10 |
| Third Layer (Green-Sensitive Layer): | |
| Silver Chlorobromide Emulsion (non-tabular, bromide content: 70 mol %, mean grain size: 0.45 μm) | 0.45 |
| Magenta Coupler (*2) | 0.35 |
| Solvent for Magenta Coupler (TOP) | 0.44 |
| Discoloration Inhibitor (*3/*4) | 0.05/0.10 |

-continued

| | |
|---|---|
| Gelatin | 1.00 |
| Fourth Layer (Ultraviolet Absorbing Interlayer): | |
| Ultraviolet Absorbent (*5/*6/*7) | 0.06/0.25/0.25 |
| Solvent for Ingredient above (TNP) | 0.20 |
| Fifth Layer (Red-Sensitive Layer): | |
| Silver Chlorobromide Emulsion (non-tabular, bromide content: 50 mol %, mean grain size: 0.45 μm) | 0.20 |
| Cyan Coupler (*8/*9) | 0.2/0.2 |
| Solvent for Cyan Coupler (TNP/DBP) | 0.10/0.20 |
| Gelatin | 0.9 |
| Sixth Layer (Ultraviolet Absorbing Interlayer): | |
| Ultraviolet Absorbent (*5/*6/*7) | 0.06/0.25/0.25 |
| Solvent for Ingredient above (DBP) | 0.20 |
| Gelatin | 0.15 |
| Seventh Layer (Protective Layer): | |
| Gelatin | 1.5 |

DBP represents dibutyl phthalate, TOP represents tri(n-octyl phosphate), and TNP represents tri(n-nonyl phosphate). The structural formulae of other ingredients are given below:

(*1)

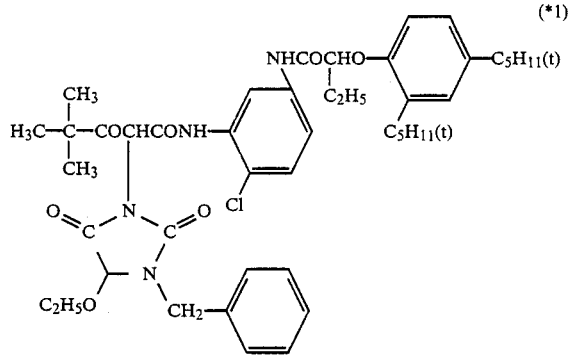

(*2)

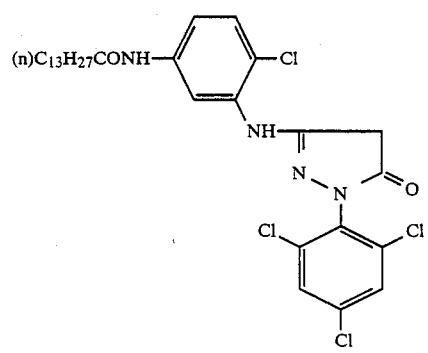

(*3)

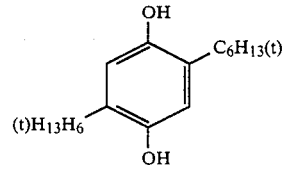

-continued (*4)

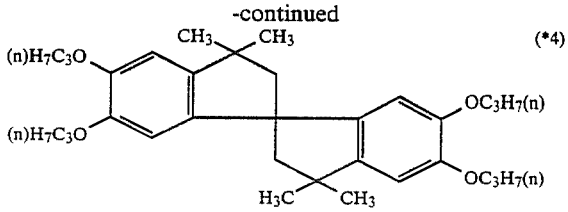

(*5)

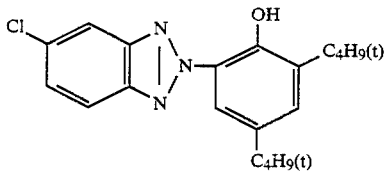

(*6)

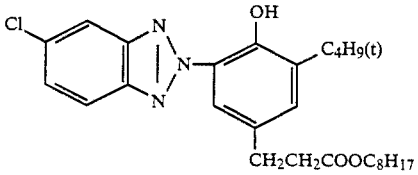

(*7)

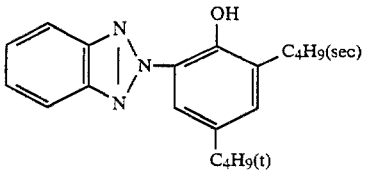

(*8)

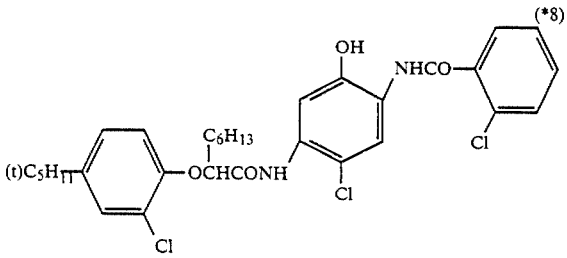

(*9)

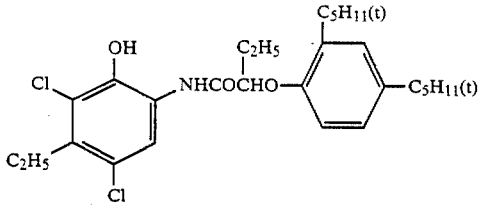

The following dyes were employed as spectral sensitizers in the corresponding emulsion layers.

Blue-Sensitive Emulsion Layer:

Triethylammonium 4-[5-chloro-2-{5-chloro-3-(4-sulfonatobutyl)benzothiazoline-2-ylidenemethyl}-3-benzothiazolyl]butanesulfonate ($2\times10^{-4}$ mole per mole of silver halide)

Green-Sensitive Emulsion Layer:

Sodium Salt of 3,3'-di-(γ-sulfopropyl)-5,5'-diphenyl-9-ethyloxacarbocyanine ($2.5\times10^{-4}$ mole per mole of silver halide)

Red-Sensitive Emulsion Layer:

Sodium Salt of 3,3'-di-(γ-sulfopropyl)-9-methylthiadicarbocyanine ($5\times10^{-4}$ mole per mole of silver halide)

The dyes shown below were employed as anti-irradiation dyes in the corresponding emulsion layers.

Green-Sensitive Emulsion Layer:

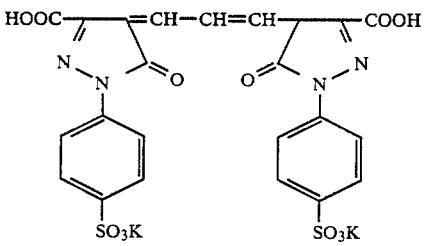

Red-Sensitive Emulsion Layer:

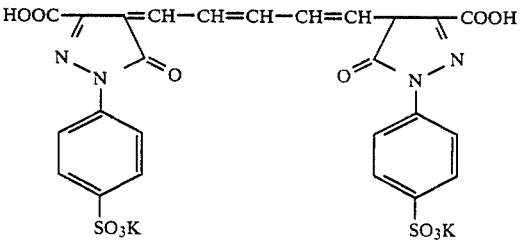

The thus obtained light-sensitive material was named Sample 101.

Light-sensitive materials were produced in the same manner as Sample 101 except that Emulsions B to I were employed in place of Emulsion A in their respective blue-sensitive emulsion layers and, further, the sensitizing dye for the blue-sensitive layer was used in such amounts as to effect the optimal spectral sensitization in the respective emulsions. The thus obtained materials were named Samples 102 to 109, respectively. These samples were subjected to gradation exposure for sensitometry through a blue filter utilizing an enlarger (Fuji Color Head 609, produced by Fuji Photo Film, Co., Ltd.), and then development processed according to the standard high temperature process (1) or the LR process (2).

| Steps in Standard High Temperature Process (1) | Temperature | Time |
|---|---|---|
| Development | 33° C. | 3.5 min |
| Bleach-Fix | 33° C. | 1.5 min |
| Washing | 24–35° C. | 3.0 min |
| **Composition of Developing Solution** | | |
| Trisodium Nitrilotriacetate | | 2.0 g |
| Benzyl Alcohol | | 15 ml |
| Diethylene Glycol | | 10 ml |
| $Na_2SO_3$ | | 2.0 g |
| KBr | | 0.5 g |
| Hydroxylamine Sulfate | | 3.0 g |
| 4-Amino-3-methyl-N-ethyl-N-{β-(methanesulfonamido)ethyl}-p-phenylenediamine Sulfate | | 5.0 g |
| $Na_2CO_3$ (monohydrate) | | 30 g |
| Water to make | | 1 l |
| pH adjusted to | | 10.1 |
| **Composition of Bleach-Fix Bath** | | |
| Ammonium Thiosulfate (70 wt %) | | 150 ml |
| $Na_2SO_3$ | | 15 g |
| $NH_4[Fe(EDTA)]$ | | 55 g |
| EDTA.2Na | | 4 g |
| Water to make | | 1 l |
| pH adjusted to | | 6.9 |
| **Step in LR Processing Process (2)** | **Temperature** | **Time** |
| Development | 38° C. | 3.5 min |
| Bleach-Fix | 33° C. | 1.5 min |
| Washing | 24–35° C. | 3.0 min |

-continued

| Composition of Developing Solution | |
|---|---|
| Diethylenetriaminepentaacetic Acid | 4.0 g |
| Benzyl Alcohol | 15 ml |
| Diethylene Glycol | 10 ml |
| $Na_2SO_3$ | 2.0 g |
| KBr | 1.0 g |
| $Na_2CO_3$ (monohydrate) | 30.0 g |
| N-Ethyl-N-(β-methanesulfonamidoethyl)-3-methyl-4-aminoaniline Sulfate | 5.0 g |
| Hydroxylamine Sulfate | 4.0 g |
| Brightening Agent (of the stilbene type) | 1.0 g |
| Water to make | 1 l |
| pH adjusted to | 10.10 |
| **Composition of Bleach-Fix Bath** | |
| Ammonium Thiosulfate (70 wt %) | 150 ml |
| $Na_2SO_3$ | 18 g |
| $NH_4[Fe(EDTA)]$ | 55 g |
| EDTA.2Na | 5 g |
| Water to make | 1 l |
| pH adjusted to | 6.70 |

In order to examine the developability of each blue-sensitive emulsion layer, each sample was developed changing the development time from 0.5 minute to 3.5 minutes at fifteen-second intervals after gradation exposure for sensitometry. The color developing solution for the process (1) was used and the shortest development time necessary to achieve the same maximum yellow color density as that obtain by the 3.5 minutes' development was determined as a measure of developability. Moreover, in order to examine the tendancy to fog in the high temperature LR processing which the blue-sensitive emulsions each received, each sample was developed for 5.5 minutes according to the LR process (2). The yellow fog value of the thus processed sample was determined to be the "forced development fog value". The results are shown in Table 1 together with the profile of every sample where, the sensitivities are shown in relative values, with Sample 101 being taken as 100.

TABLE 1

| | Emulsion Used | | | Standard Processing (1) | | | LR Processing (2) | | |
|---|---|---|---|---|---|---|---|---|---|
| Sample No. | Name | Shape | AgBr Content (mol %) | Sensitivity | Fog | Developability | Sensitivity | Fog | Forced Development Fog |
| 101 | Emulsion A | Tabular | 85 | 100 | 0.03 | 1'15" | 100 | 0.03 | 0.05 |
| 102 | Emulsion B | Tabular | 93 | 104 | 0.02 | 1'30" | 103 | 0.03 | 0.05 |
| 103 | Emulsion C | Tabular | 96 | 107 | 0.02 | 1'30" | 105 | 0.02 | 0.02 |
| 104 | Emulsion D | Tabular | 98 | 107 | 0.02 | 1'30" | 105 | 0.02 | 0.02 |
| 105 | Emulsion E | Tabular | 100 | 108 | 0.02 | 2'15" | 105 | 0.02 | 0.02 |
| 106 | Emulsion F | Non-tabular | 85 | 95 | 0.03 | 2'45" | 92 | 0.03 | 0.05 |
| 107 | Emulsion G | " | 96 | 96 | 0.02 | 3'00" | 92 | 0.02 | 0.03 |
| 108 | Emulsion H | " | 50 | 90 | 0.04 | 2'00" | 89 | 0.06 | 0.10 |
| 109 | Emulsion I | " | 10 | 80 | 0.05 | 1'30" | 80 | 0.09 | 0.14 |

Only Sample 103 and Sample 104 are in accordance with the present invention.

As can be seen from the results shown in Table 1, tabular silver chlorobromide grains (Samples 101 to 104) had developabilities equivalent to that of the massive grains having a high silver chloride content (Sample 109). On the other hand, fog was suppressed with an increase in the AgBr content, irrespective of the grain shape. In particular, fog due to the high temperature LR processing was found to below when the AgBr content was raised up to 96 mol % or more (Sample 103 and Sample 104). In comparison, the fog was very liable to be generated with the non-tabular grains having a high silver chloride content, which imparted excellent developability to them (Sample 108 and Sample 109). Accordingly, only when the emulsions prepared in accordance with the present invention were employed did the sensitive materials prove to have excellent developability and processing stability and further have high sensitivity and low fog values even in the high temperature, rapid and LR processing.

As can be seen from Samples 103 and 104 versus Sample 105, the emulsions of the present invention contain some chloride. Thus, in Samples 103 and 104 the chloride content as AgCl was 4 mole % (100–96 ) and 2 mole % (100–98).

In relatively broad form, the emulsions comprise at least 95 mole % bromide, not more than 2 mole %, and most preferably 0% silver iodide, balance chloride.

Thus, the AgCl content be a maximum of 5 mole % (95 mole % bromide; 0 mole % silver iodide) or a minimum of 3 mole % (95 mole % bromide; 2 mole % silver iodide) for 95 mole % bromide.

In most preferred forms as shown in Samples 103 and 104, the AgCl content would be from 2 to 4 mole % (Sample 103 to Sample 104).

While the invention has been described in detail and with reference to specific embodiments thereof, it will be apparent to one skilled in the art that various changes and modifications can be made therein without departing from the spirit and scope thereof.

What is claimed is:

1. A process for forming a color image which comprises developing at a temperature of 30° C. or more, an image-wise exposed silver halide color photographic material comprising a support having thereon at least one silver halide photographic emulsion, wherein said silver halide photographic emulsion comprises silver halide grains in which tabular grains are present so as to account for at least 50% of the total projected area of all grains present, said tubular grains having an average aspect ratio of not less than 5, and the halide composition of the silver halide being from 96 to 98 mole % bromide, no iodide and the remainder chloride, with a color developing solution, wherein the content of KBr in the initial developing solution is adjusted to 1.0 g/l or more, and the amount of replenisher added to the replenishing amount in standard processing, and then bleaching and fixing, or bleach-fixing.

2. The process of claim 1, wherein said tabular grains have an average aspect ratio of 5 to 8.

3. The process of claim 1, wherein said tubular grains are present so as to account for at least 85% of the total projected area of all grains present.

4. The process of claim 1, wherein the diameter of said tabular grains is from 0.1 to 10 μm.

5. The process of claim 4, wherein the diameter of said tabular grains is from 0.2 to 5.0 μm.

6. The process of claim 5, wherein the diameter of said tabular grains is from 0.3 to 2.0 μm.

7. The process of claim 1, wherein the thickness of said tabular grains is 0.3 μm or less.

8. The process of claim 1, wherein said silver halide photographic emulsion is chemically sensitized.

* * * * *